US007527024B2

(12) United States Patent
Hosoda et al.

(10) Patent No.: US 7,527,024 B2
(45) Date of Patent: May 5, 2009

(54) LIQUID FUEL REFORMER

(75) Inventors: Yuzo Hosoda, Tokyo (JP); Waichi Sugiyama, Yokohama (JP)

(73) Assignee: Hosoda Electric Co., Ltd., Tokyo (JP)

( * ) Notice: Subject to any disclaimer, the term of this patent is extended or adjusted under 35 U.S.C. 154(b) by 794 days.

(21) Appl. No.: 10/482,242

(22) PCT Filed: Feb. 4, 2003

(86) PCT No.: PCT/JP03/01101

§ 371 (c)(1),
(2), (4) Date: Dec. 18, 2003

(87) PCT Pub. No.: WO03/083279

PCT Pub. Date: Oct. 9, 2003

(65) Prior Publication Data

US 2005/0103284 A1 May 19, 2005

(30) Foreign Application Priority Data

Mar. 29, 2002 (JP) ..... 2002-130976
Apr. 10, 2002 (JP) ..... 2002-142204

(51) Int. Cl.
*F02B 43/08* (2006.01)

(52) U.S. Cl. ..... 123/3; 422/186; 422/186.01; 422/222; 123/119; 123/445; 123/536; 123/537; 123/538; 210/223; 210/425

(58) Field of Classification Search ..... 123/670, 123/445, 536, 537, 538, 539, 119; 422/186.01, 422/222; 44/412; 210/425, 223, 222; 431/356, 431/3, 121; 204/168
See application file for complete search history.

(56) References Cited

U.S. PATENT DOCUMENTS 4,188,296 A * 2/1980 Fujita ..... 210/222
4,373,494 A * 2/1983 McMahon ..... 123/538
4,572,145 A * 2/1986 Mitchell et al. ..... 123/538
4,711,271 A * 12/1987 Weisenbarger et al. ..... 137/827

(Continued)

FOREIGN PATENT DOCUMENTS

JP 11 33268 12/1999

OTHER PUBLICATIONS

U.S. Appl. No. 60/344,019.*

*Primary Examiner*—Alexa D Neckel
*Assistant Examiner*—Imran Akram
(74) *Attorney, Agent, or Firm*—Michael A. Glenn; Glenn Patent Group

(57) ABSTRACT

A light, compact and low-cost liquid fuel reformer for removing the harmful substances within the exhaust gas discharged from vehicles having two magnet holding cases (3, 3') accommodating respectively anisotropic metallic materials (7, 7'). The magnet holding cases (3') and (3) are magnetically secured each other at respective commissure (3*a*, 3*a'*), pinching connecting tube (24) made of nonmagnetic material through which the liquid fuel flows. The magnetic fields generated by the anisotropic magnetic materials (7) and (7') are orthogonal to the connecting tube. The connecting tube has an outer tube (24A) made of nonferrous metal and an inner tube (24B) made of nonferrous metal. These two types of nonferrous metal are selected so as to generate an electric potential difference between the outer tube (24A) and the inner body tube (24B).

20 Claims, 12 Drawing Sheets

U.S. PATENT DOCUMENTS 5,129,382 A * 7/1992 Stamps et al. ..... 123/536
5,167,782 A * 12/1992 Marlow ..... 204/168
5,882,514 A * 3/1999 Fletcher ..... 210/223
6,007,715 A * 12/1999 Liu et al. ..... 210/222
2003/0019804 A1* 1/2003 Hagans ..... 210/222
2003/0150816 A1* 8/2003 Sacs ..... 210/695

* cited by examiner

LIQUID FUEL REFORMER

FIELD OF INVENTION

This invention relates to a liquid fuel reformer for reforming materials included in liquid fuel for gasoline engines or diesel engines and causing Carbon Monoxide (CO), Carbon Hydride (HC), Nitrogen Oxide (NOx), black smoke and others in exhaust gas exhausted from vehicles.

BACKGROUND OF THE INVENTION

In order to remove the harmful substances such as CO, HC or NOx, etc. included in exhaust gas from vehicles, installing a catalytic converter in the exhaust system from engine to muffler has been widely adopted. As a catalytic converter, the three-element catalyst converter that uses Platinum (Pt), Palladium (Pd), Rhodium (Rh), Zeolite, etc. is used mostly common. This three-element catalyst converter is formed in honeycomb-like structure made of these materials. While the converter is used, exhaust gas with a temperature of 800_ is passed through the opening part of the honeycomb structure, so that oxidation and reduction with the harmful substances within the exhaust gas may take place. Poisonous CO and HC are oxidized to generate harmless $CO_2$ and $H_2O$, respectively. Furthermore, poisonous NOx is deoxidized to generate harmless $N_2$ and $O_2$. This is the principle of the three-element catalyst converter's operation. This three-element catalyst converter may take a shape of planular, elliptic cylinder, with a longitudinal size of 20-50 cm and a thickness of 10-20 cm. Weight of the unit including accessories is 10-20 kg.

On the other hand, in case of Diesel engines, mixed gas self-ignites by compression in the combustion chamber, and then the exhaust gas is evacuated through the exhaust pipe. Due to this operation principle, it is impossible to have the mixed gas completely combusted. Therefore, in case of Diesel engine, it is difficult to suppress the black smoke that is generated accompanying with imperfect combustion. The black smoke causes not only generation of air pollution, but also generation of a highly toxic dioxin or a carcinogenic substance by reacting with Cl, etc. At present, Diesel Particular Filter (DPF) consisting of an afterburner and a replaceable filter has been installed at the exhaust side in order to remove the black smoke generated from Diesel engine.

Exhaust gas regulations being strengthened, it has become necessary to install two or three catalyst converters in the exhaust system of the gasoline engine vehicles. FIG. 1 shows three catalyst converters equipped to a vehicle. The three-element catalyst converter 1 are provided in series between the exhaust manifold 2 and the muffler 4 in the exhaust system starting from the engine 5 and reaching the muffler 4. As described above, since the three-element catalyst converter has a substantial volume, there is a problem of difficulty to reserve a room to place two or three catalyst converters. In addition, since the catalyst converter has a significant thickness of 10 cm, when this is installed on the vehicle's floor, the vehicle's floor must be raised up, which results in a problem that decreases the inner space of the vehicle.

Furthermore, since the weight of the catalyst converter is 10-20 kg per unit, installing three catalyst converters means that the total weight of the vehicle increases by some tens of kilograms. Also, since the DPF is as heavy as 100 kg per unit, a problem of weight increase in case of Diesel engine is more serious than the case of gasoline engine. Such an increase of weight generates another problem of too much consumption of fuel. In addition, since the DPF is very expensive, it causes a problem of cost when DPF is equipped to vehicles.

Accordingly, the purpose of the invention is to provide a compact, light and low-cost liquid fuel reformer enabling to remove harmful substances from exhaust gas of vehicles.

SUMMARY OF THE INVENTION

The above purpose of the invention is achieved by a liquid fuel reformer consisting of one magnet holding case made of magnetic material accommodating one anisotropic magnetic material and another magnet holding case made of magnetic material accommodating another anisotropic magnetic material, one magnet holding case and another magnet holding case being magnetically secured so as to construct a part of magnetic induction circuit at each commissure, pinching the connecting tube made of nonmagnetic material through which the liquid fuel flows, the magnetic fields generated by one anisotropic magnetic material and another anisotropic magnetic material being orthogonal to the connecting tube, characterized in that the connecting tube consists of an outer tube made of nonferrous metal and an inner tube made of nonferrous metal which is different from that of the outer tube, accommodated inside the outer tube, and has a flowing path extended from the inlet side to the outlet side of the connecting tube between the surface of the inner tube and the inner surface of the outer tube, and these two kinds of nonferrous metal are selected so as to generate an electric potential difference between the outer tube and the inner tube consisting of one magnet holding case made of magnetic material accommodating an anisotropic magnetic material and another magnet holding case made of magnetic material accommodating an anisotropic magnetic material, one magnet holding case and another magnet holding case being stuck magnetically each other so as to construct a part of magnetic induction circuit at each commissure and to pinch the connecting tube made of nonmagnetic material through which the liquid fuel flows, and in the liquid fuel reformer in which the magnetic fields that are generated by the one type and the opposite type of anisotropic magnetic materials are crossing orthogonally to the connecting tube, characterized in that the connecting tube consists of an outer tube made of nonferrous metal and an inner tube made of nonferrous metal which is different from that of the outer tube, accommodated inside the outer tube, and has a flowing path extended from the inlet side to the outlet side of the connecting tube between the surface of the inner tube and the inner surface of the outer tube, and these two kinds of nonferrous metal are selected so as to generate an electric potential difference between the outer tube and the inner tube.

On the metallic elements residing in the liquid fuel within the connecting tube to which a magnetic field is vertically applied, static charges are generated. These charged metallic elements are removed from liquid fuel by Lorentz force. As the result, the liquid fuel after passing through this liquid fuel reformer never generates black smoke or dioxin, etc.

On the other hand, by applying a magnetic field to the liquid fuel flowing through the connecting tube, an electromotive force is generated in the liquid fuel, which fines the chain bond of carbon hydride compound in the liquid fuel. When the chain bond of carbon hydride compound is fined, surface area of fuel increases due to the drop of combustion temperature. When the combustion temperature drops, NOx is not generated, combustion is accelerated, generation of black smoke is suppressed owing to perfect burning, and the combustion efficiency is improved.

There exists an electric potential difference (assuming the standard potential as H=0 V) between these two different type nonferrous metals, respectively constituting the outer tube and the inner tube. That is, a battery is formed between the outer tube and the inner tube. The electric potential difference, in addition to the above electromotive force, also acts to fine the chain bond of carbon hydride in liquid fuel flowing through the outer path and the inner path. Thus, owing to those both operations, chain bond of carbon hydride is efficiently fined. This is the reason why the liquid fuel reformer of the invention can dramatically decrease the amount of generation of CO, HC, NOx and black smoke from the exhaust gas.

The liquid fuel reformer of the invention is characterized in that the outer tube is made of nonferrous metal that generates a positive unipolar potential and the inner tube is made of nonferrous metal that generates a negative unipolar potential.

It is desirable to use such a nonferrous metal with physico-chemical characteristic which is hard to be oxidized or corroded, has a small ionization tendency, and is monovalent, bivalent or trivalent, and whose unipolar potential is positive, more specifically, Au, Ag Cu or Pt as a material of the outer tube.

On the other hand, as a material of the inner tube, it is desirable to use such a nonferrous metal with physico-chemical characteristic which has a large ionization tendency, and is monovalent, and whose unipolar potential is negative, more specifically, Ti, W, or Al.

The liquid fuel reformer characterized in that the anisotropic magnetic body has a rectangular shape top surface of which is rectangular generates stronger magnetic field compared with other one whose top surface is not rectangular (for example, circular).

The liquid fuel reformer characterized in that, at the corner of the magnet holding case, a curve with a bent angle of 56° or more may realize a strong magnetic induction closed circuit without magnetic flux leakage. The magnetic induction closed circuit means the circuit magnetic in which filed does not exist outside the magnet holding case.

In this patent application, the "liquid fuel" means any liquid-state fuel including carbon hydride (CH) in nature, such as gasoline, light oil, kerosene, heavy oil, or ethanol.

In this patent application, the "vehicle" means any kind of land mobile measures utilizing a gasoline engine or a Diesel engine, such as a car, a truck, a bus, a Diesel car, a shovel car, a motorbike, a snow mobile, etc. The gasoline engine or Diesel engine installed with the liquid fuel reformer of the invention can be also applied to transportation measures for on-water or under-water, such as a motorboat and a vessel, etc.

The operation principle of the liquid fuel reformer of the invention can be also applied to a jet engine. Therefore, even in case of a jet engine, it is possible to remove harmful substances from the exhaust gas by supplying the reformed liquid fuel by the liquid fuel reformer of the invention.

The jet engine installed with the liquid fuel reformer of the invention is also available for an aircraft.

DETAILED DESCRIPTION OF EMBODIMENTS

Figure 1:
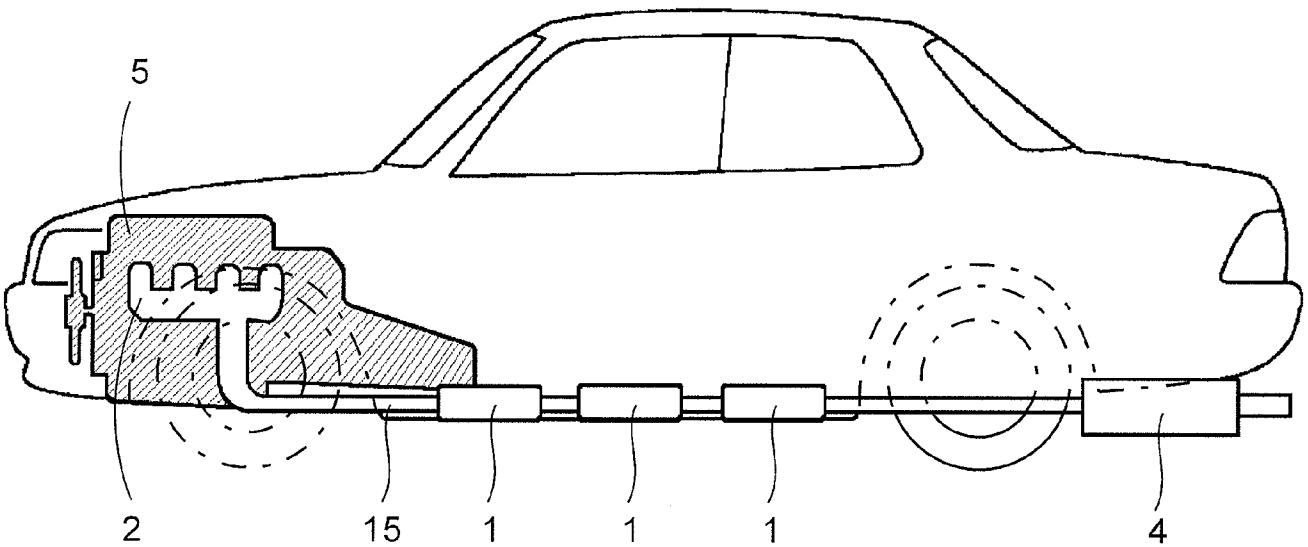
FIG. 1 shows a vehicle equipped with catalyst converters.
Figure 2:
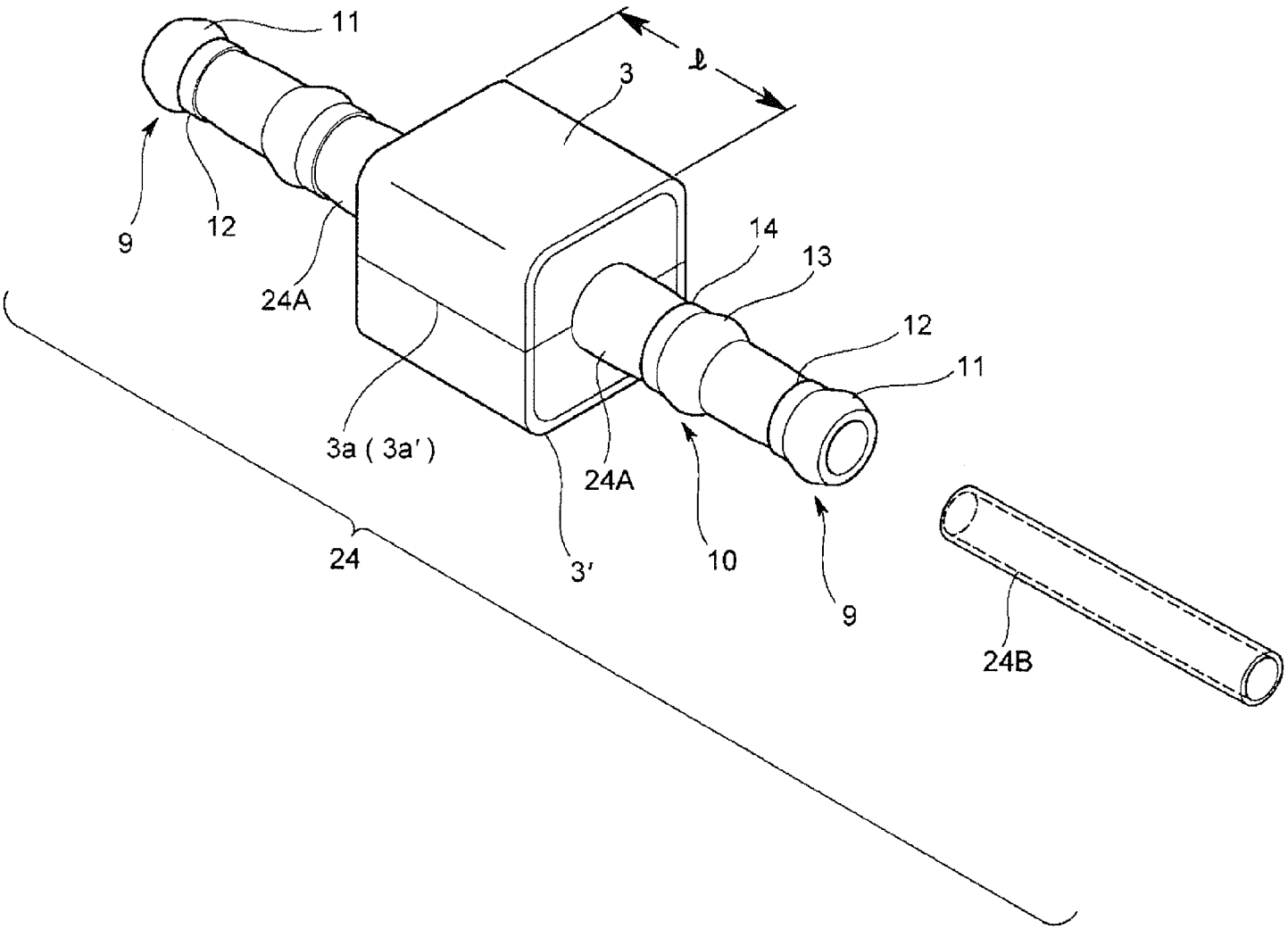
FIG. 2 is a perspective view of liquid fuel reformer of the invention.

The liquid fuel reformer of the invention consists of one magnet holding case 3, another magnet holding case 3' and the connecting tube 24 as shown in FIG. 2.

Because one magnet holding case 3 and another magnet holding case 3' have the same structure, only one magnet holding case 3 will be described. The magnet holding case 3 is made of soft iron material and has a box type shape. Length l of the magnet holding case 3 and 3' in FIG. 2 is 40 mm. The magnet holding case 3 has a bottom plane 3A, left and right plane 3B and 3C, and front and back plane 3D and 3E. In the peripheral edge of the front and back plane, a semicircular opening is formed. A permanent magnet 7 with a shape of cuboid whose thickness is 10 mm and whose top surface is rectangular (dimension of 20 mm×25 mm) is fixed firmly on the inner surface of bottom plane 3A of the magnet holding case 3. The permanent magnet 7 is made of anisotropic magnetic material. Inside the magnet holding case 3, a synthetic resin, a non-magnetic material as a filling material 8 consisting of, for example, epoxy resin, is filled up to fix the magnet. At the center of the filling material 8, the permanent magnet 7 is partly exposed. In order to avoid leaking of magnetic flux, a curve with a bent angle of 56° or more is formed at the corner of the magnet holding case 3.

Figure 3:
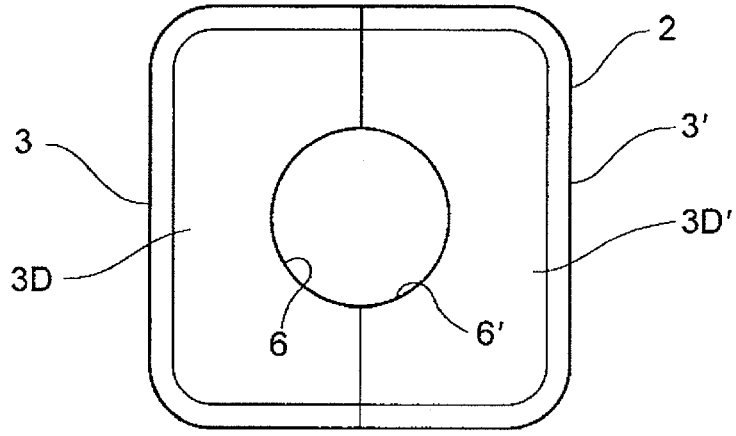
FIG. 3 is a front view of magnet holding case of the liquid fuel reformer of the invention.

As shown in FIG. 3, the magnet holding case 3 and 3' are combined to one body by means of mutual magnetic force, forming a circular opening into which the connecting tube 24 is inserted by semicircular openings 6 and 6'. The connecting tube 24 made of non-magnetic material consists of the outer tube 24A and the inner tube 24B. The internal diameter and the external diameter of the outer tube 24A of the connecting tube 24 are 5-6 mm and 7-8 mm, respectively. The internal diameter and the external diameter of the inner tube 24B of the connecting tube 24 are approximately 3 mm and 4 mm, respectively. The length of the outer tube 24A is 115 mm, and one of the inner tube 24B is 24 mm. The total weight of the outer and inner tube bodies is 250 g. The outer tube 24A is made of nonferrous metal that is hard to be oxidized and corroded and has a small ionization tendency. The nonferrous material with a small ionization tendency may be Au, Ag Cu or Pt.

At each side of this outer tube 24A, a joint part 9 for 8 mm hose and a joint part 10 for 9 mm hose are provided, respectively. The joint part 9 for 8 mm hose has an expanded part 11 and a hook part 12 for preventing falling off, and the joint part 10 for 9 mm hose has an expanded part 13 and a hook part 14 for preventing falling off.

A material with physico-chemical characteristic which has a large ionization tendency, and is monovalent and whose unipolar potential is negative, for example, Ti, W or Al, is used as a material of the inner tube 24B.

Figure 4:
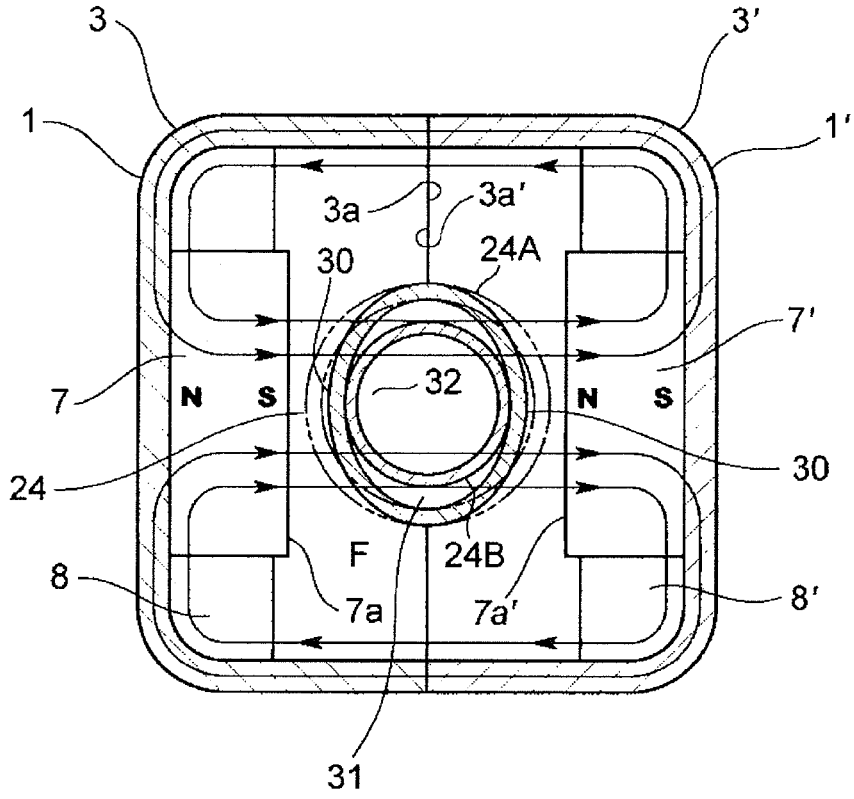
FIG. 4 is a cross sectional view at the center of magnet holding case.

As shown in FIG. 4, a crushed part 30 is formed by crushing the opposing parts at the center of outer tube 24A, the inner tube 24B being accommodated concentrically inside the outer tube 24A. The inner tube 24B is accommodated concentrically inside the outer tube 24A and fixed to it by the crushed part 30. Between the inner tube 24B and the outer tube 24A, an outer flowing path 31 is formed except the crushed part 30.

Figure 5:
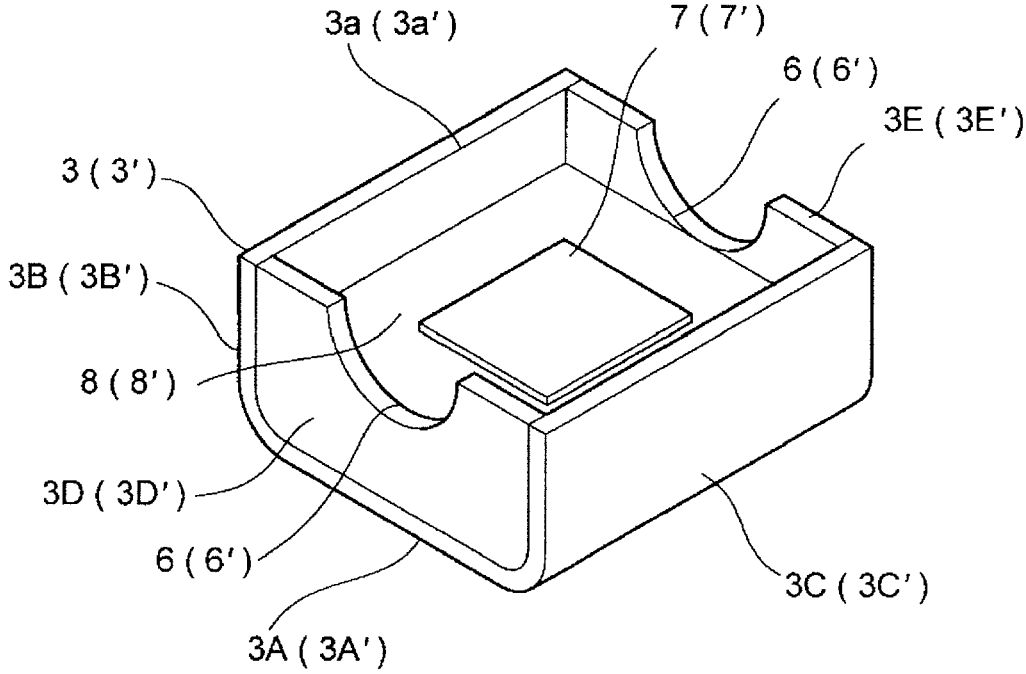
FIG. 5 is a perspective view of magnet holding case (part of it was omitted).

As shown in FIG. 4, the magnet holding case 3 and 3' are fixed at respective commissure (edge part) 3*a* and 3*a*', and the connecting tube 24 passes through the circular hole formed by the semicircular openings 6 and 6' (see FIG. 5). The permanent magnet 7 and 7' oppose each other, nipping the connecting tube. Opposing edge of the permanent magnet 7 is S-pole and opposing edge of the permanent magnet 7' is N-pole.

As shown in FIG. 4, the magnet holding case 3 and 3' are united to construct a continuous frame body. The frame body forms a magnetic induction closed circuit. The size of cross section shown in FIG. 4 is 40 mm×40 mm, and the total weight of the magnet holding case 3 and 3' is 200 g. The frame body forms a part of so-called "magnetic circuit". A magnetic field with high magnetic flux density (6,000 to 8,000 Gauss) is formed from the facing end portion (S-pole) 7*a* of the permanent magnet 7 to the facing end portion (N-pole) 7*a*' of the permanent magnet 7' in the magnet holding case 3. Magnetic field lines F go through the connecting tube 24, pass the center of the frame body 10 and converge to the permanent magnet 7. Magnetic circuit (induced magnetic circuit) is formed by the magnetic field lines F. By forming a curve with a bent angle of 56° or more at the corner of the magnet holding case, a magnetic induction closed circuit without magnetic flux leakage is realized.

Flow velocity of liquid fuel flowing through the inner and outer path 31, 32 is 1.2-1.6 m/sec, the fuel pressure of the liquid fuel is 2-3 kg and the discharge rate of the liquid fuel is 60-110 l/hour.

A small amount of metallic elements such as Ca, Na, Mg, K, Al, Fe, and Ti, etc. exist in the liquid fuel. Although these metallic elements themselves are not harmful, they might generate harmful compounds such as chlorides, bromides, or sulfides by chemically reacting with Cl, Br, S, etc. while the liquid fuel is burning. Since these chlorides, bromides or sulfide is considered to be related to generation of harmful substances such as black smoke or dioxin, these metallic elements included in the liquid fuel should desirably be removed.

A magnetic field of 6,000-8,000 Gauss applied perpendicularly to the fuel generates static charges on the metallic elements within the liquid fuel flowing through the connecting tube 24, which corresponds to static current of 0.06 mA and 0.08 mA in case the flow rate is 1.2 m/sec and 1.6 m/sec, respectively. These metallic elements are removed from the liquid fuel by Lorentz force. This is the reason why the metallic elements are completely removed from the liquid fuel by the liquid fuel reformer of the invention, even if amount of them is small and, as the result, black smoke or dioxin is not generated while the liquid fuel is burning.

On the other hand, applying a magnetic field of 6,000 to 8,000 Gauss to the liquid fuel flowing through the connecting tube 24 generates an electromotive force on the liquid fuel, which fines the chain bond of a carbon hydride compound within the liquid fuel. When the chain bond of carbon hydride is fined, surface area of the fuel increases, so that the combustion temperature of the liquid fuel drops. As the combustion temperature drops, NOx is generated less, so that the combustion efficiency is improved. By fining the chain bond of the fuel, surface area of fuel is increased and combustion is accelerated, so that generation of black smoke is suppressed owing to perfect burning.

An electric potential difference between the respective potential of theses two different nonferrous metals (assuming the standard potential as H=0), constituting respectively the outer tube and the inner tube exists. Namely, a battery is formed between the outer tube and the inner tube. For example, if the outer tube 24A is made of Au (the unipolar potential of Au is 1.7) with physico-chemical characteristic that has a positive unipolar potential and is monovalent and bivalent, and the inner tube 24B is made of Ti (the unipolar potential of Ti is −1.75) with physico-chemical characteristic that has a negative unipolar potential and is monovalent, a potential difference of 3.45 V is generated between the outer tube 24A and the inner tube 24B. The electric potential difference, same as the above electromotive force, also acts to fine the chain bond of carbon hydride in liquid fuel flowing the outer and inner flowing paths 31, 32. Thus, owing to both operations of these, chain bond of carbon hydride is efficiently fined. This is the reason why the liquid fuel reformer of the invention can dramatically decrease the amount of generation of CO, HC, NOx and black smoke from the exhaust gas.

The combination of metallic materials used for the outer tube 24A and the inner tube 24B is not limited to a combination of Au and Ti. In case of combinations such as Au and Al, Pt and Ti, Pt and Al, Ag and Ti, as well as Cu and Ti for the outer tube 24A and the inner tube 24B, potential difference is generated between them.

Figure 6:
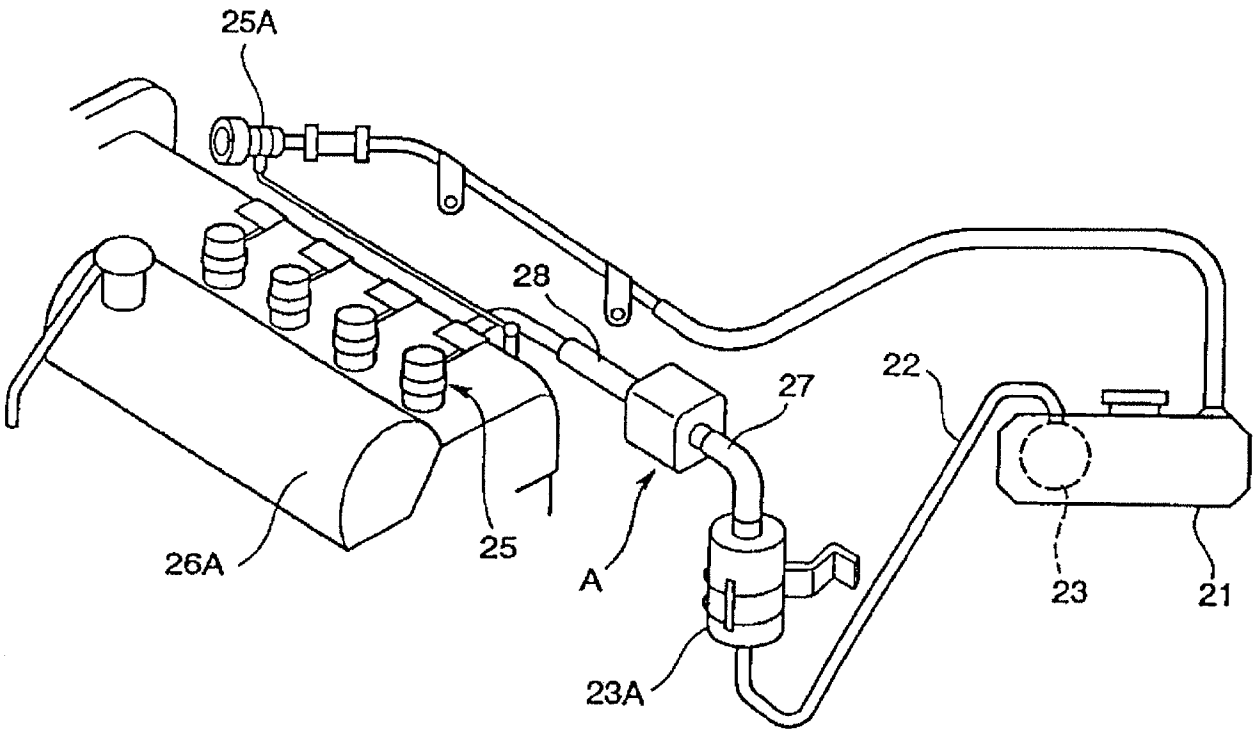
FIG. 6 shows the structure of the fuel supply system of gasoline engine of vehicles.
Figure 7:
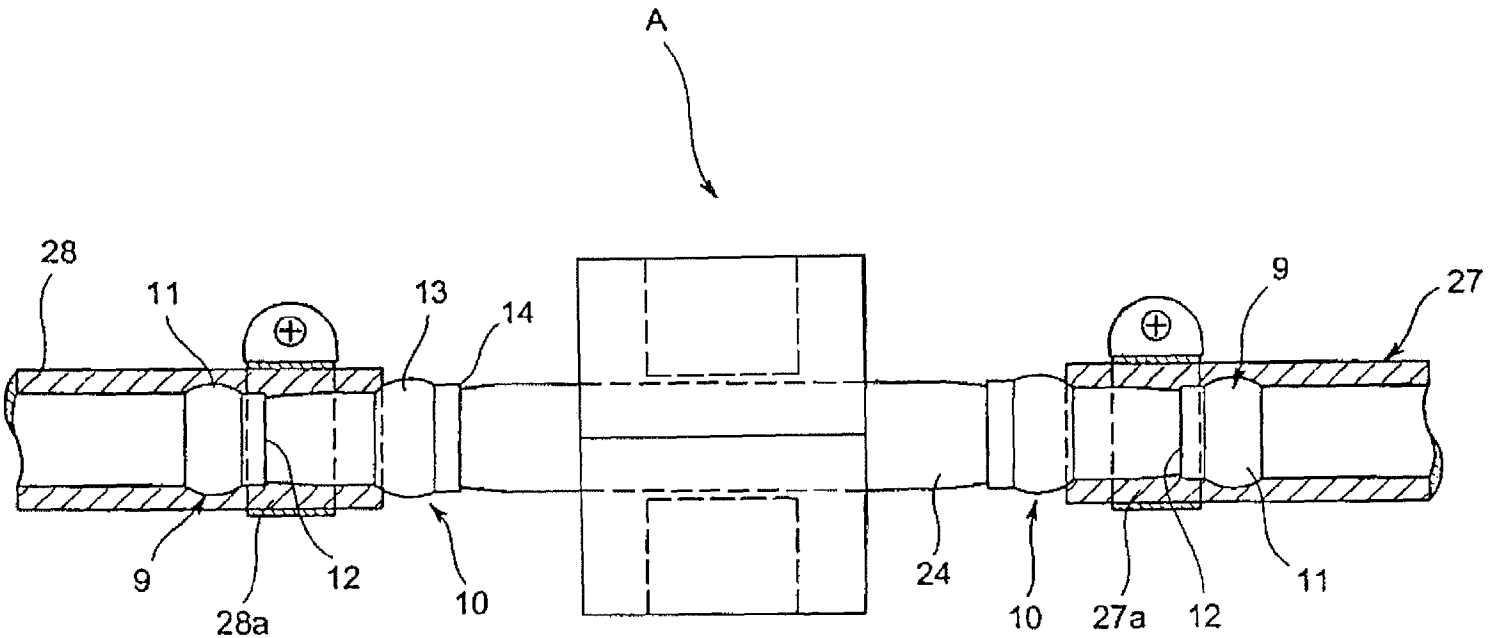
FIG. 7 is a drawing to explain the connection between the connecting tube of liquid fuel reformer of the invention and the fuel hose of the gasoline engine's fuel system.

An example where the liquid fuel reformer of the invention is installed to the fueling system of the gasoline engine vehicle will be described hereinafter, referring to FIG. 6 and FIG. 7. The fueling system of gasoline engine vehicle supplies a mixed gas of fuel and air into a cylinder. As shown in FIG. 6, the liquid fuel reformer has a fuel tank 21, a fuel supply pump 23 accommodated in the fuel tank 21, a fuel filter 23A connected to the discharge side of the fuel supply pump 23 through the fuel hose 22, and an injector 25 connected to the fuel filter 23A through the fuel hose 27 and mounted to the intake manifold 26A side. Gasoline as the liquid fuel is supplied into the fuel supply tube 23 inside the fuel tank 21 by means of the fuel supply pump, and gasoline discharged from this fuel supply pump 23 is transferred to the injector 25 after filtered by the fuel filter 23A, then it is vaporized and injected into the cylinder. Here, 25A denotes a pressure regulator.

A fuel hose 27 with a diameter of 8 mm made of synthetic resin is connected to the discharge side of the fuel supply pump 23. One end of connecting tube 24 of the reformer A is connected to the end 27*a* of the fuel hose 27 by joint part 9 for the 8 mm fuel hose. The end 28*a* of different fuel hose 28 is connected to the another end of the connecting tube 24 of the reformer A with a joint part 9 for the 8 mm fuel hose, and the another end of this fuel hose 28 is connected to the injector 25.

As described above, the liquid fuel reformer of the invention is light and compact, because the dimension of its magnet holding case 3 and 3' is 40 mm, the length of the connecting tube is 115 mm, and the total weight is only 250 g. Therefore, as already described, this device can be attached directly to the fuel hose connecting the engine and the fuel tank. Moreover, different from the conventional catalyst converters that process the exhaust gas from an engine, very clean liquid fuel is supplied to the engine, because the liquid fuel reformer of the invention removes the harmful substances within the liquid fuel to be supplied to the engine. Accordingly, the amount of harmful substances is dramatically reduced, and the efficiency of removal of harmful substances is considerably greater than the one of the conventional catalyst converters. In contrast, the conventional catalyst converter is as large as 50 cm×10 cm×10 cm in size, and as heavy as 10 kg in weight. Therefore, when considering these size and weight, the fact that the weight of the liquid fuel reformer of the invention is less than 1/200 of the conventional catalyst converter and the removal efficiency of harmful substances is greater than the conventional one apparently shows how the technical advantage of the invention is great.

We measured contents of the exhaust gas, using an exhaust gas measurement equipment MEXA-554J manufactured by Horiba, under the air/fuel ratio being constant, for 2,400 cc Datsun with the liquid fuel reformer of the invention where Au is used for the outer tube 24A and Ti for the inner tube 24B and without such liquid fuel reformer. According to the result, in case the reformer of the invention was not installed, amount of exhausted CO and HC was respectively 0.10% vol and 31 ppmvol, but in case the reformer of the invention was installed, the amount of CO and HC was respectively 0.01% vol and −2 ppmvol (which is less than the measurement error, so that it is impossible to measure). The amount of CO was dramatically reduced to 1/10, and also the amount of HC was decreased from 31 ppmvol down to the level impossible to measure.

Next, the measurement results on the effect for cars with the conventional three-element catalyst converter and for cars with the liquid fuel reformer of the invention will be shown hereinafter.

REFERENCE EXAMPLE

Figure 8:
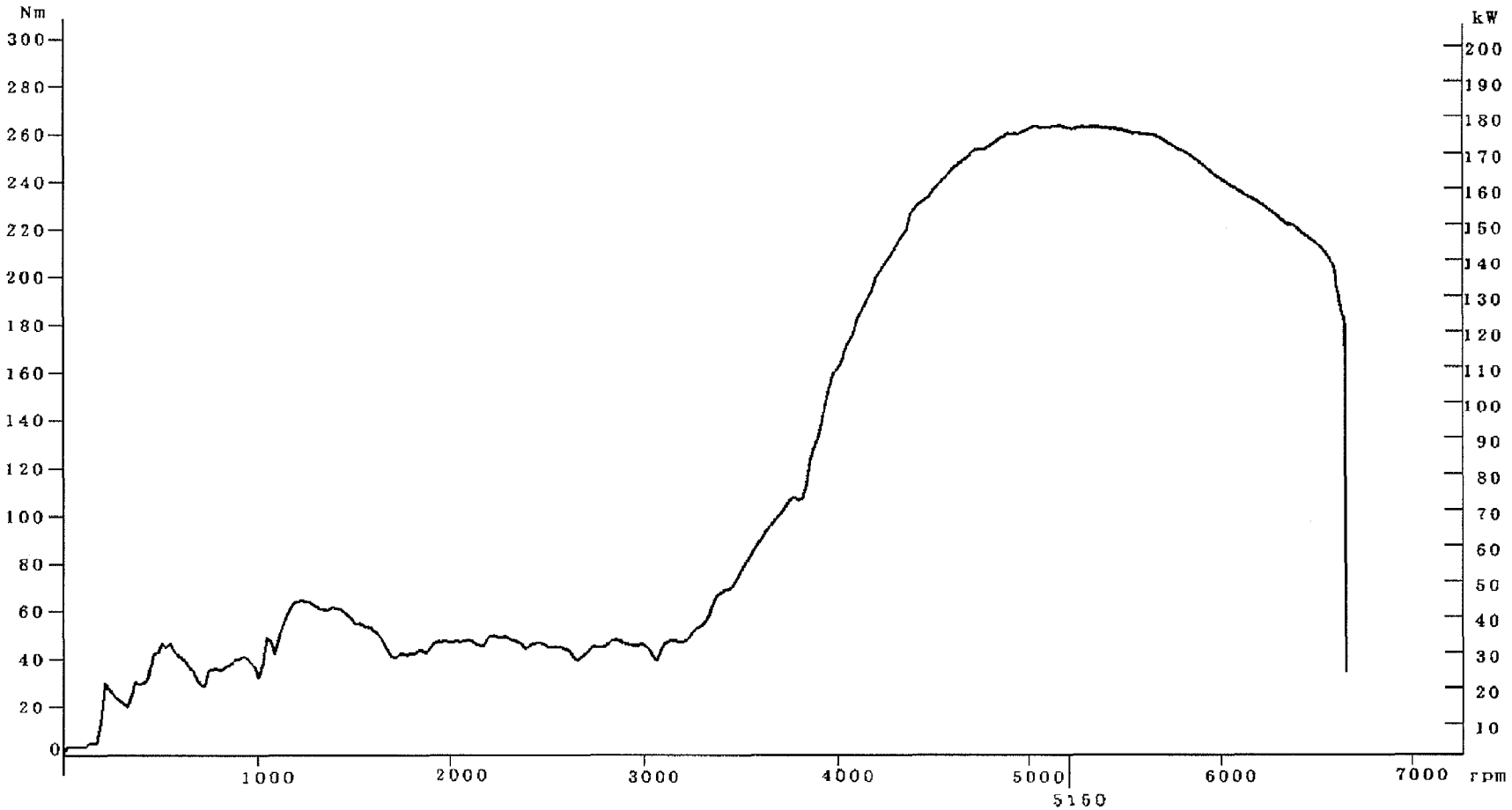
FIG. 8 shows the measurement result on relationship between the revolution speeds and the torque of the vehicle installed with three-element catalyst converter.

Change of torque was measured for a front-drive, automatic car with the maximum speed of 240 km/h where the three-element catalyst converter was installed, changing the revolution speed of the engine. The result is shown in FIG. 8. In FIG. 8-FIG. 11, the vertical axis corresponds to the torque of engine (unit: Nm) and the horizontal axis corresponds to the revolution speed (rpm) of engine. As shown in FIG. 8, for the vehicle where the three-element catalyst converter is installed, the torque is only about 50 Nm in the range of 0-3,200 rpm.

Example 1

Figure 9:
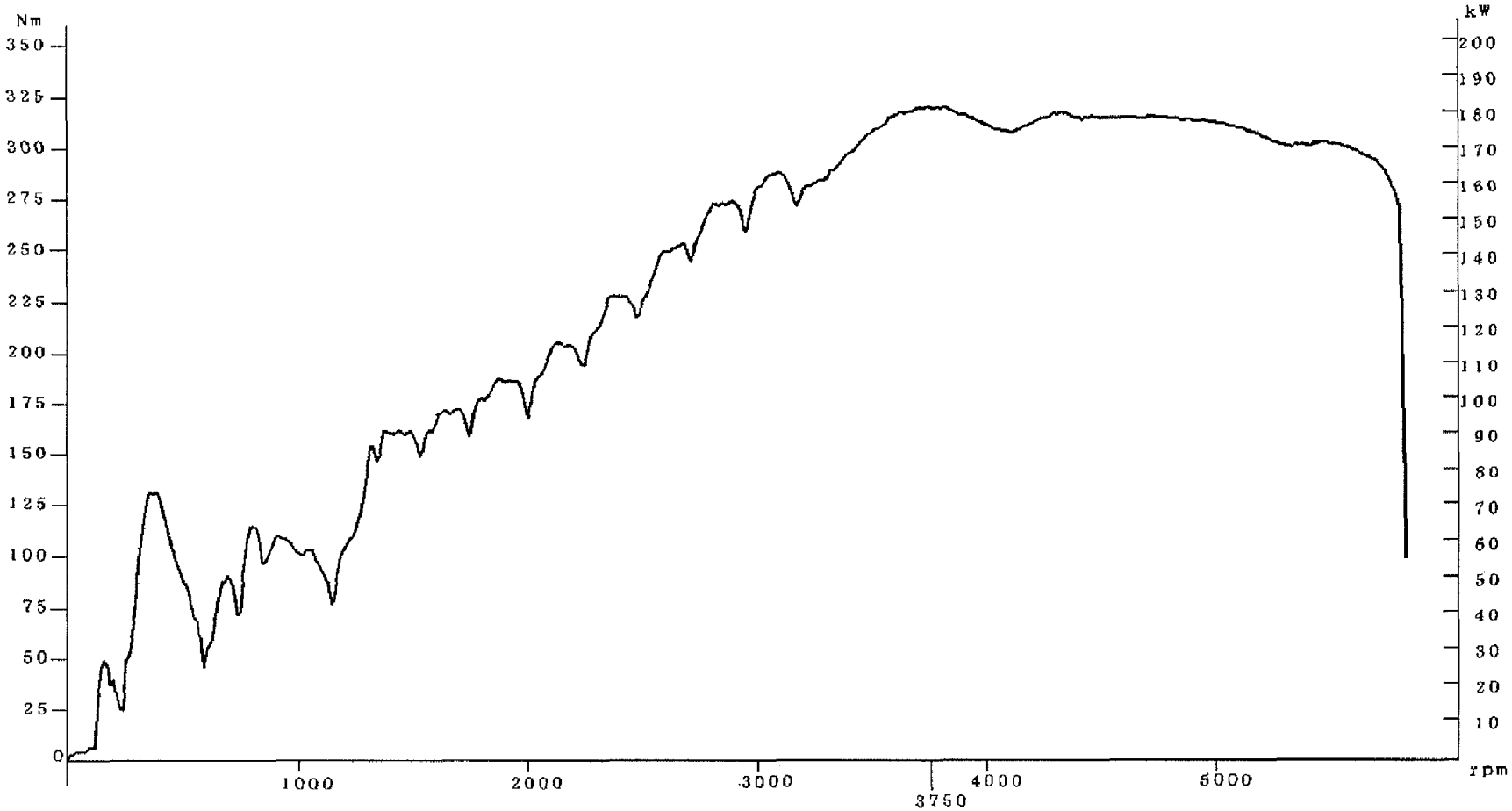
FIG. 9 shows the measurement result of an example 1 of the invention.

We measured the change of torque, changing the revolution speed of engine, for a front-drive, automatic car with the maximum speed of 200 km/h installed with the reformer of the invention in which Au is used for the outer tube 24A and Ti for the inner tube 24B, under the magnetic field of 6,500 Gauss. The result of this measurement is shown in FIG. 9. Comparison of FIG. 9 and FIG. 8 shows that the torque was improved in Example 1 over the full range of revolution speed, especially, improved greatly under 4,000 rpm.

Example 2

Figure 10:
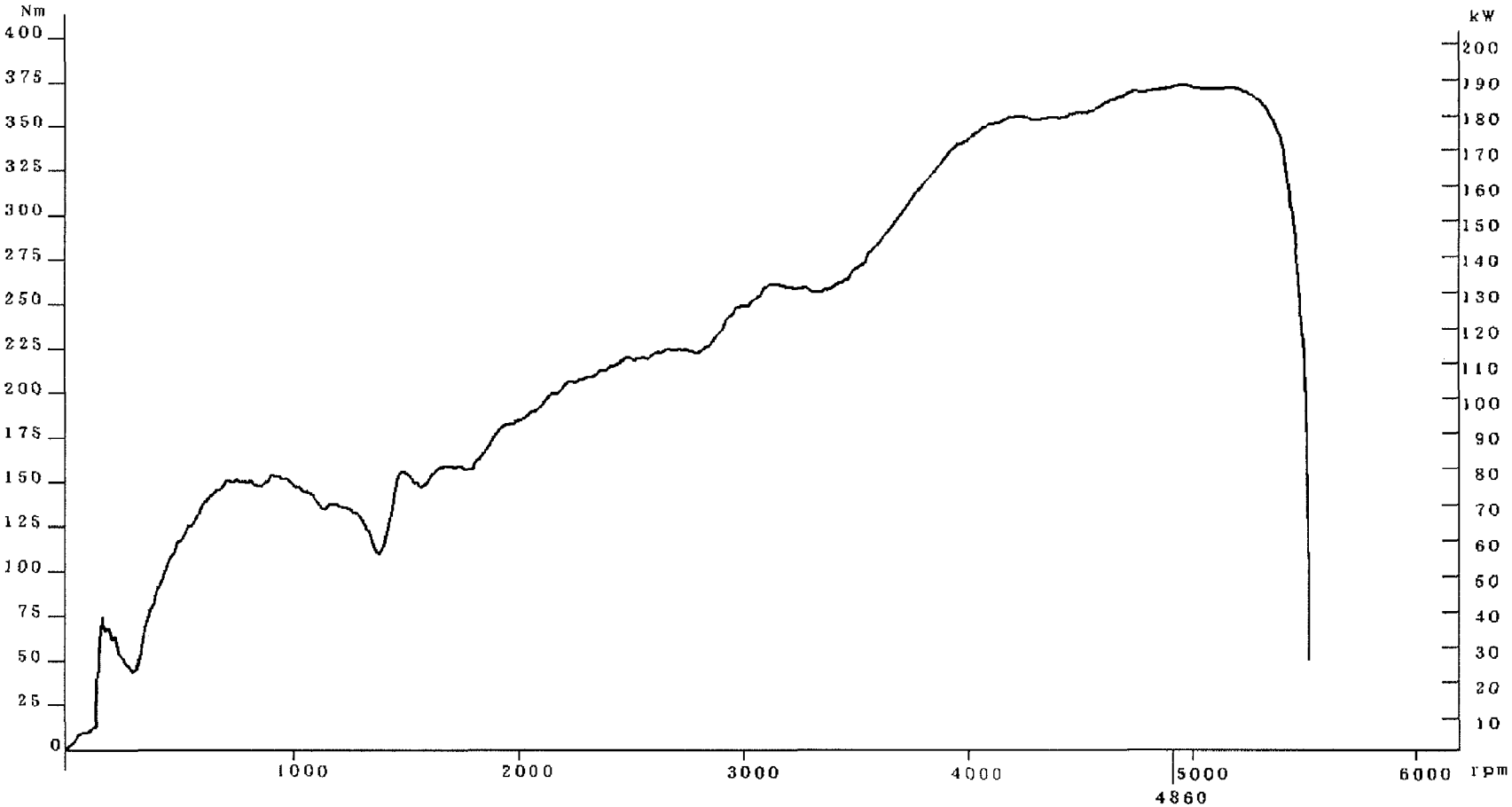
FIG. 10 shows the measurement result of an example 2 of the invention.

We measured the change of torque, changing the revolution speed of engine, for a front-drive, automatic car with the maximum speed of 200 km/h installed with the reformer of the invention in which Ti is used for the outer tube 24A and Al for the inner tube 24B, under the magnetic field of 6,500 Gauss. The result of this measurement is shown in FIG. 10. Comparison of FIG. 10 and FIG. 8 shows that the torque was improved in Example 2 over the over the range of 0-4,200 rpm. For example, in case of Example 2, at 3,000 rpm, the torque becomes 4 times greater than that of the Comparison Example.

Example 3

Figure 11:
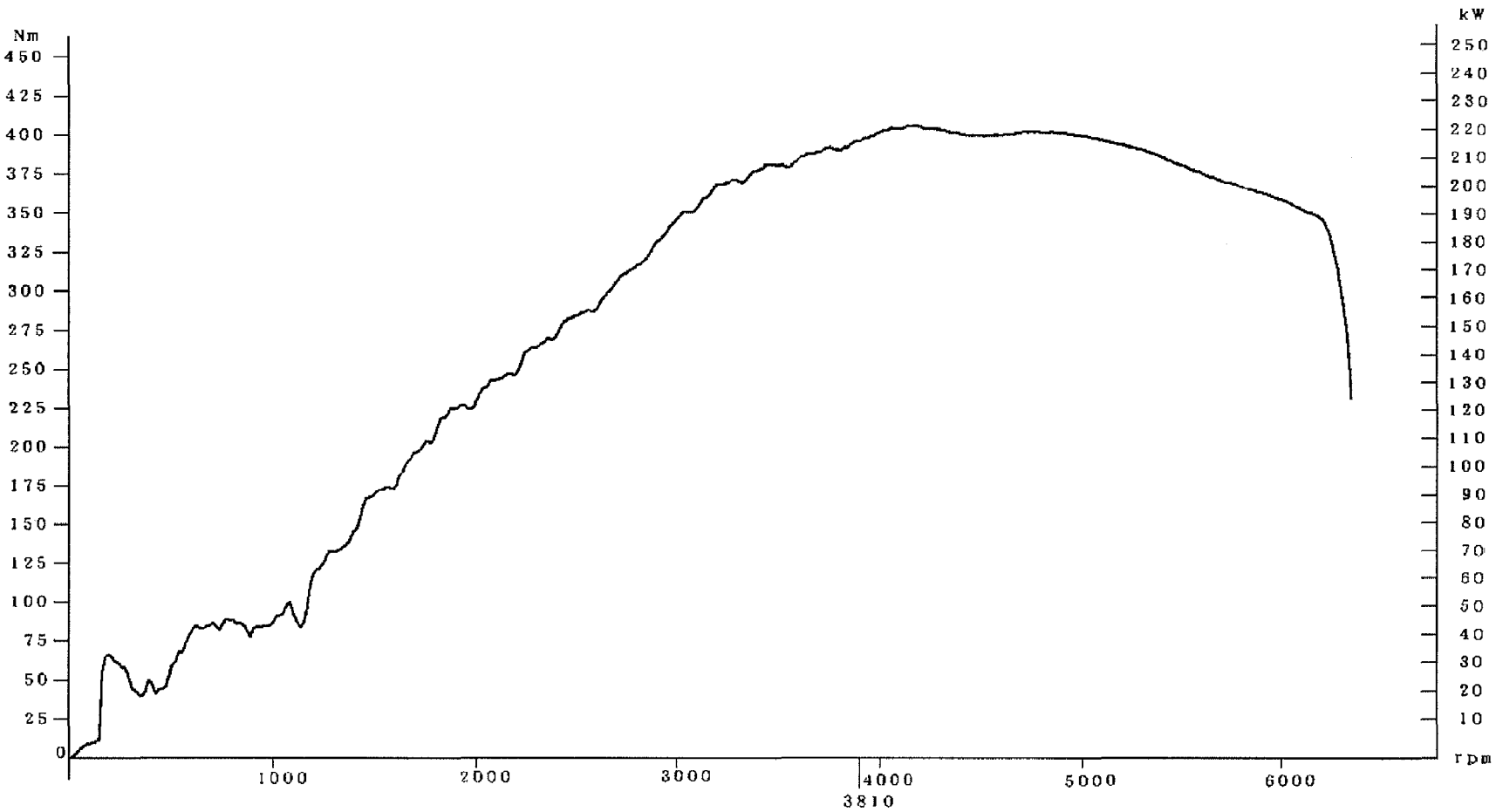
FIG. 11 shows the measurement result of an example 3 of the invention.

We measured the change of torque, changing the revolution speed of engine, for a front-drive, automatic car with the maximum speed of 200 km/h installed with the reformer of the invention in which Au is used for the outer tube 24A and Ti for the inner tube 24B, under the magnetic field of 6,500 Gauss. The result of this measurement is shown in FIG. 11. Comparison of FIG. 11 and FIG. 8 shows that the torque was improved in Example 3 over the full range of revolution speed, especially, improved greatly below 4,000 rpm.

Figure 12:
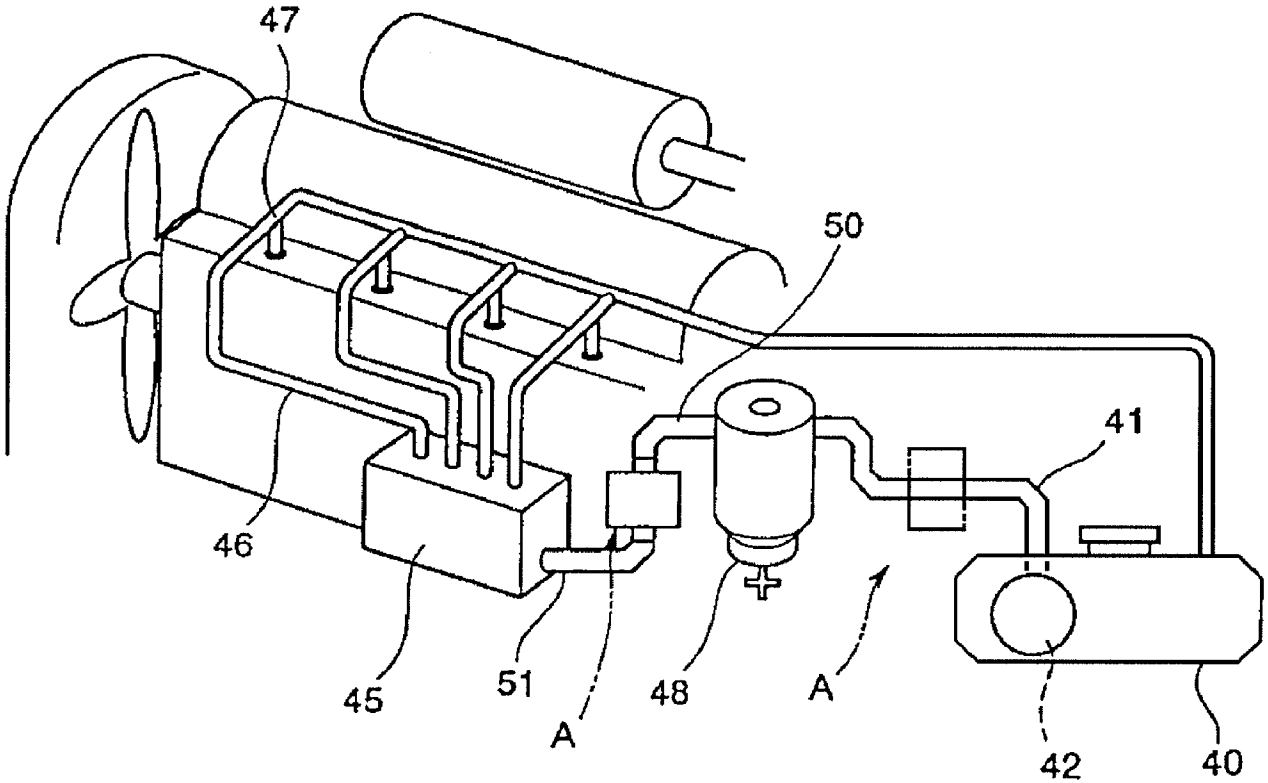
FIG. 12 shows the structure of the fuel supply system in a Diesel engine of vehicles.
Figure 13:
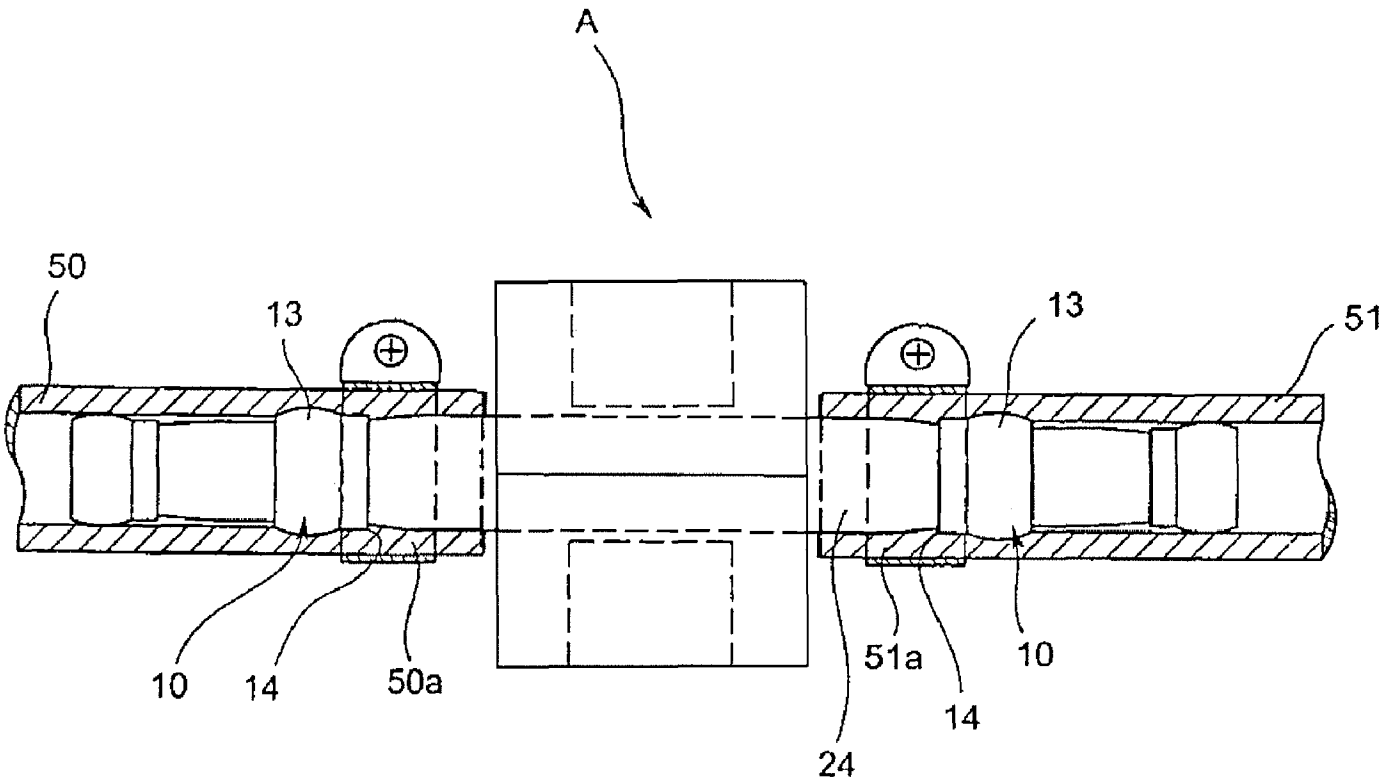
FIG. 13 is a drawing to explain the connection between the connecting tube of liquid fuel reformer of the invention and the fuel hose of the Diesel engine's fuel system.

Hereinafter we will describe the example where the liquid fuel reformer of the invention A was installed in the fuel supply system of Diesel engine vehicle, referring to FIG. 12 and FIG. 13.

The fuel supply system of Diesel engine vehicles consists of a fuel tank 40, a fuel supply pump 42 accommodated in the fuel tank 40, a distributor 45 connected by fuel hose 41 via the fuel filter 48 to discharge side of this fuel supply pump 42, and a spray nozzle connected via the spray tube 46 to the distributor 45.

A fuel hose 50 with 9 mm diameter made of synthetic resin is connected at the outlet side of the fuel filter 48. At the rear end 50*a* of the fuel hose 50, one end of connecting tube 24 of the reformer A is connected by joint part 10 of the 9 mm fuel hose. The end 51*a* of different fuel hose 51 is connected to the another end of the connecting tube 24 of the reformer A by a joint part 10 for the 8 mm fuel hose, and the another end of this fuel hose 51 is connected to the distributor 4.

The liquid fuel reformer may provide at the inlet side of the fuel filter 48. In this case, the liquid fuel reformer is not provided at the outlet side of the fuel filter 48.

Although, examples of the liquid fuel reformer of the invention to a gasoline engine and a Diesel engine are herein described, the operation principle of the liquid fuel reformer of the invention may be also applied to a jet engine. Therefore, even in case of jet engine, it is possible to remove the harmful substances from the exhaust gas by supplying the reformed liquid fuel by the liquid fuel reformer of the invention.

INDUSTRIAL AVAILABILITY

The liquid fuel reformer of the invention is well suited for applying to the device that removes the harmful substances from exhaust gas discharged from gasoline engines or Diesel engines and is replaceable with the conventional three-element catalyst converter and Diesel particle Filter (DPF). In addition, the liquid fuel reformer of the invention can be well applied also to the device that removes the harmful substances from exhaust gas discharged from jet engines.

The invention claimed is:

1. A liquid fuel reformer comprising:

a first magnet holding case comprised of a first anisotropic magnetic material, the first magnet holding case forming a curve at each corner; and a second magnet holding case comprised of a second anisotropic magnetic material, the second magnet holding case forming a curve at each corner;

wherein the first and second magnet holding cases are magnetically secured and touching, so as to constitute a magnetic induction closed circuit without magnetic flux leakage and to construct a part of the magnetic induction closed circuit at each commissure, and wherein the first and second magnet holding cases comprise a front plane and a back plane that each define a semicircular opening for pinching a connecting tube comprised of nonmagnetic material through which liquid fuel flows there between;

wherein the magnetic fields generated by the first and second anisotropic magnetic material are orthogonal to the connecting tube;

wherein the connecting tube comprises an outer tube comprised of a first nonferrous metal and an inner tube comprised of a second nonferrous metal, the first nonferrous metal being different from the second nonferrous metal, the inner tube being accommodated inside the outer tube, and wherein a flowing path extended from an inlet side to an outlet side of the connecting tube is constituted by between a surface of the inner tube and an inner surface of the outer tube;

wherein the first non-ferrous metal generates positive unipolar potential, and the second non-ferrous metal generates negative unipolar potential; and wherein the first and second nonferrous metals are selected so as to generate an electric potential difference between the outer tube and the inner tube.

2. The liquid fuel reformer according to claim 1, wherein the first non-ferrous metal is selected from the group consisting of Au, Ag, Cu and Pt.

3. The liquid fuel reformer according to claim 1, wherein the second non-ferrous metal is selected from the group consisting of Ti, W, or Al.

4. The liquid fuel reformer according to claim 1, wherein each of the anisotropic magnetic material is in the shape of a cuboid with a rectangular top surface.

5. The liquid fuel reformer according to claim 1, wherein a curve with a bent angle of 56° or more is formed at the corner of the magnet holding case.

6. A gasoline engine system in which the liquid fuel reformer according to claim 1 is installed between an engine and a liquid fuel tank.

7. A gasoline engine system in which the liquid fuel reformer according to claim 1 is installed between an engine and a liquid fuel tank.

8. A gasoline engine system in which the liquid fuel reformer according to claim 2 is installed between an engine and a liquid fuel tank.

9. A gasoline engine system in which the liquid fuel reformer according to claim 3 is installed between an engine and a liquid fuel tank.

10. A gasoline engine system in which the liquid fuel reformer according to claim 4 is installed between an engine and a liquid fuel tank.

11. A Diesel engine system in which the liquid fuel reformer according to claim 1 is installed between an engine and a liquid fuel tank.

12. A Diesel engine system in which the liquid fuel reformer according to claim 2 is installed between an engine and a liquid fuel tank.

13. A Diesel engine system in which the liquid fuel reformer according to claim 3 is installed between an engine and a liquid fuel tank.

14. A Diesel engine system in which the liquid fuel reformer according to claim 4 is installed between an engine and a liquid fuel tank.

15. A jet engine system in which the liquid fuel reformer according to claim 1 is installed between an engine and a liquid fuel tank.

16. A vehicle installed with the gasoline engine system according to claim 6.

17. A vehicle installed with the Diesel engine system according to claim 11.

18. A vessel installed with the gasoline engine system according to claim 6.

19. A vessel installed with the Diesel engine system according to claim 11.

20. An airplane installed with the jet engine system according to claim 15.

* * * * *